United States Patent [19]

Knapp, Jr.

[11] Patent Number: 4,684,915

[45] Date of Patent: Aug. 4, 1987

[54] THERMOPLASTIC INSULATING BARRIER FOR A FILLERLESS ELECTRIC FUSE

[75] Inventor: Edward J. Knapp, Jr., Merrimac, Mass.

[73] Assignee: Gould Inc., Rolling Meadows, Ill.

[21] Appl. No.: 814,562

[22] Filed: Dec. 30, 1985

[51] Int. Cl.[4] ..... H01H 85/18; H01H 85/38

[52] U.S. Cl. ..... 337/276; 337/273

[58] Field of Search ..... 337/276, 273, 278, 280

[56] References Cited

U.S. PATENT DOCUMENTS 3,492,619 1/1970 Hager et al. ..... 337/276

FOREIGN PATENT DOCUMENTS 1203861 9/1970 United Kingdom ..... 337/276

*Primary Examiner*—Harold Broome

*Attorney, Agent, or Firm*—Frederick A. Goettel, Jr.

[57] ABSTRACT

A fillerless electric fuse having a wire-like fusible element is provided with a body of thermoplastic material which cooperates with the fusible element to establish an impermeable barrier within the fuse between the fuse end terminals. The thermoplastic material is preferably a hot melt adhesive introduced into the casing in a fluid state.

6 Claims, 3 Drawing Figures

THERMOPLASTIC INSULATING BARRIER FOR A FILLERLESS ELECTRIC FUSE

BACKGROUND OF THE INVENTION

1. Field of the Invention

This invention relates to electric fuses of relatively sma11 dimension which are used to interrupt relatively small currents in relatively high voltage circuits.

2. Description of the Prior Art

Where electric fuses are used to protect relatively high voltage circuits and are provided with short casings, it is customary to fill those casings with a granular arc-quenching filler material. However, where the amperages of such fuses are small the fill conducts away so much heat from the fusible element that the cross sectional area of the elements must be extremely small to obtain the desired melting characteristics. Such extremely small diameter wires are very difficult to work with when manufacturing such fuses. If no fill is used, the heat conducted from the fusible element will be less and a larger, more manageable wire may be used.

Further, the cross sectional area of the fusible elements of such fuses are so small that if a filler is used it is difficult to obtain uniform heat transfer from the fusible elements to the surrounding arc-quenching filler material. For example, if the arc quenching filler material is a granular material such as quartz sand, there will be minute voids between the grains of the arc-quenching material and the fusible elements, the voids having a lower heat transferring capability than the grains of sand. On the other hand, if the arc-quenching material is a granular material having a finer grain, such as gypsum, the forces which must be used to compact the arc-quenching filler material within the casings of the fuses can displace the fusible elements from their intended positions within the casings, and may even break the fusible elements. Even if a fine grain arc-quenching material such as gypsum, could be compacted around the fusible element without breaking the element, the arc-quenching material could develop cracks or voids when the fuse was handled, such cracks or voids having a lower heat transfer capability than the body of filler material.

Further, regardless of whether a large or fine grain arc-quenching filler material is used, the filling of such small fuse casings is an extremely tedious and delicate operation and the vibration and other handling of the fuse associated with achieving a good void-free fill could often result in breakage of the extremely fine wire-like elements in such low amperage fuses.

Consequently, it is desirable to provide low amperage electric fuses which are capable of protecting relatively high voltage circuits which may be provided with extremely short casings, wire-like elements, and that are devoid of granular arc-quenching filler material. One such electric fuse design is disclosed in U.S. Pat. No. 3,460,086 entitled PROTECTORS FOR ELECTRIC CIRCUITS to A. J. Fister.

The present invention provides an electric fuse which satisfies all of the above requirements and which establishes an impermeable barrier within the fuse casing around the fusible element between the respective end terminals of the fuse to thereby isolate the terminals from one another. As a result, when the fusible element melts, the impermeable barrier prevents the arc plasma from extending between and "feeding" on the end terminals and thus promotes quick extinguishment of the arc. Such a barrier is established without subjecting the fragile wire-like fusible elements to potentially damaging tortuous paths caused by clamping or sandwiching the element between adjacent washers and barriers or the like.

SUMMARY OF THE INVENTION

According to the present invention, a fillerless electric fuse is provided which has a tubular casing having open ends and a fusible element in the form of a wire extending from one of the open ends to the other. An electrically conductive terminal cap is secured to and closes each of the open ends of the casing, and, the fusible element is electrically conductively connected to the opposite end terminals of the fuse. A body of thermoplastic adhesive is provided inside of the fuse casing. A body of thermoplastic adhesive completely surrounds at least a portion of the length of the fusible element and is in intimate contact with the inner surface of the fuse casing to thereby establish an impermeable barrier within the casing between the terminal caps. In a preferred embodiment the thermoplastic body is a hot melt adhesive introduced into the casing in a fluid state.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiments when read in connection with the accompanying drawings wherein like numbers have been employed in the different figures to denote the same parts and wherein:

DESCRIPTION OF THE PREFERRED EMBODIMENTS

Figure 1:
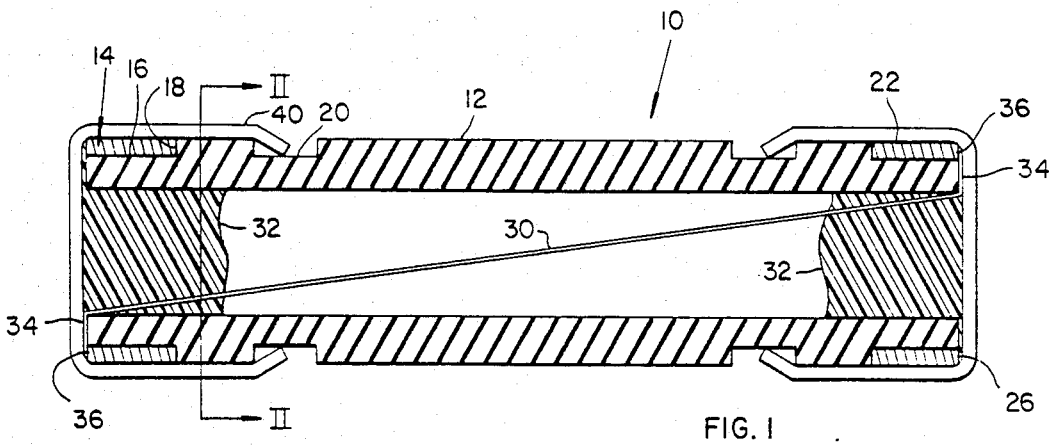
FIG. 1 is a longitudinal section through one preferred embodiment of an electric fuse that is made in accordance with the principles and teachings of the present invention.
Figure 2:
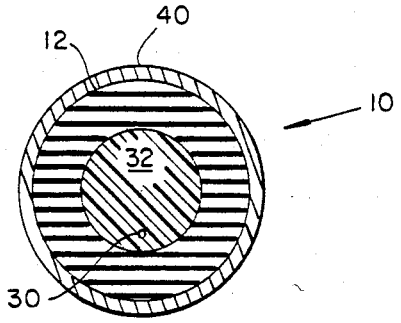
FIG. 2 is a sectional view taken along the line II—II of FIG. 1.

Referring now to the drawings in detail, reference numeral 10 generally refers to an electric fuse made according to the present invention. The fuse 10 includes an outer cylindrical casing or tube 12 having a predetermined outer diameter and a predetermined inner diameter and open ends. The casing 12 is made from a suitable insulating material such as, for instance, a synthetic resin glass-cloth laminate. Each end of the fuse casing 12 is provided with an open ended annular groove 14. Each of the grooves 14 are defined by an open ended section 16 having a diameter reduced from that of the predetermined diameter of the casing. Each of the grooves 14 further includes an annular shoulder 18 which faces toward the axial open ends of the casing 12 and which define the transition to the outside diameter of the fuse casing 12. A second annular groove 20 is provided at each end of the fuse casing and is spaced axially inwardly from each of the open ended grooves 14. Each of the sets of annular grooves 14, 20 may be formed in the fuse casing by a machining operation and each is made shallow relative to the thickness of the casing wall so that they will not unduly weaken the casing 12.

Figure 3:
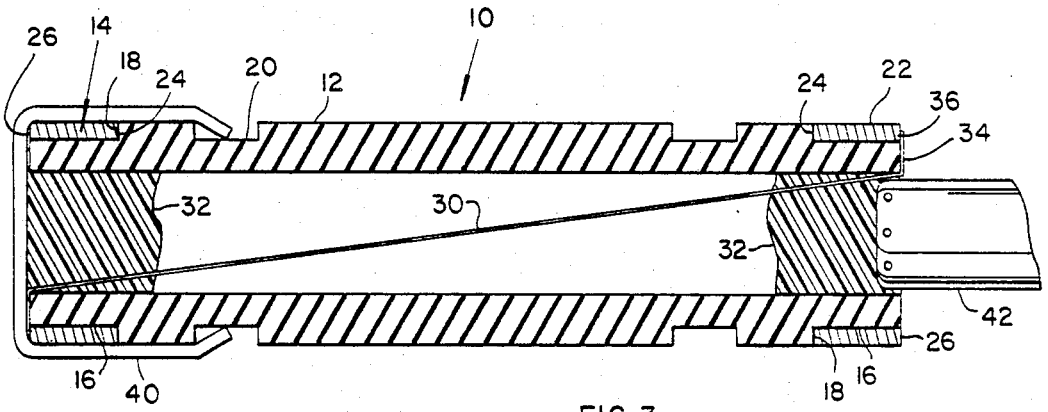
FIG. 3 is a view of the electric fuse of FIG. 1 prior to one end cap being assembled thereto showing the method of injection of the thermoplastic impermeable barrier.

Reference numeral 22 denotes a metal contact ring or element one of which is press fit onto each of the ends of the fuse casing into the open ended annular grooves 14. Each of the metal contact rings 22 has an outside diameter which is substantially the same as the predetermined outside diameter of the fuse casing 12. The inside diameter of each of the metal contact rings 22 is substantially the same as that of the annular sections of reduced diameter 16 associated with each of the open ended grooves 14. Such relationship allows the rings 22 to be readily press fit onto the annular sections of reduced diameter 16. When in such press fit relationship, as shown in FIGS. 1 and 3, a first axial end 24 of each of the rings 22 engages the annular shoulder 18 of the section of reduced diameter 16 with which the contact ring is associated. The second axial end 26 of each of the metal contact rings 22 lies in a substantially coplanar relationship with the open end of the fuse casing 12 with which the ring 22 is associated.

Reference numeral 30 denotes an elongated, small-diameter, wire-like fusible element which extends the full length of the fuse casing 12 from one open end thereof to the other. At each end of the casing 12, the fusible element 30 passes through a body of thermoplastic adhesive 32 which is disposed within the inside of each of the open ends of the casing 12. The physical characteristics of the body of thermoplastic adhesive 32 and the manner in which this body of material engages the fusible element 30 and the inside wall of the casing 12 will be described in more detail hereinbelow following the completion of the description of the overall structural details of the fuse 10.

The ends 34 of the fusible element 30 which extend beyond the open ends of the fuse casing 12 are bent at a substantially 90° angle with respect to the longitudinal axis of the fuse and are positioned into engagement with the axial end 26 of the metal contact rings 22 which are substantially coextensive with the axial open ends of the fuse casing 12. Each of the ends 34 are then welded to the axial ends 26 of contact rings 22 as indicated by the reference numeral 36. Such welding may be accomplished by well-known electrical resistance welding techniques with the welding current being suitably selected to achieve a good electrically conductive connection between the fusible element and the axial end of the contact ring without destroying or weakening the fragile wire-like fusible element. The attachment of the fusible element to the axial ends of the metal contact rings, it should be evident, is identical at each end of the fuse of the present invention.

In a preferred embodiment, fuses have been manufactured where the metal contact rings 22 are made from brass. In such applications fusible elements 30 made from tungsten wire having diameters from 0.0005–0.0026 inch have been used to make fuses having amperage ratings from 1/10 to ¾ of an amp. Fusible elements 30 made from silver wire having diameters from 0.001–0.00375 inch have been used to make fuses having amperage ratings between 4/10 to 1½ amps.

Reference numeral 40 has been applied to indicate a pair of terminal caps, preferably of a non-ferrous material such as copper or brass and plated with a good electrically conductive material such as silver or tin. The terminal caps 40 have an inside diameter such that they must be mounted under pressure, i.e. they must be press fitted over the outside diameter of the metal contact rings 22 and over a portion of the outside diameter of the fuse casing 12. The terminal caps 40 extend axially along the length of the casing 12 such that the free ends of the terminals 42 may be rolled or crimped in to the annular grooves 20 to thereby permanently secure the terminal caps 40 to the fuse casing 12.

Turning now to the body of thermoplastic adhesive 32, this material is selected from the wide range of what are known commercially as hot melt thermoplastic adhesives. One manufacturer of such materials is the Dexter Hysol Division of the Dexter Corporation. Hot melt adhesives are avialable in a variety of forms for use in a variety of different applicators. One type of applicator which lends itself to practicing the present invention are hot melt guns in which a stick of solid thermoplastic material is placed in the gun and melted and discharged by the gun upon pulling a trigger. Such guns provide smooth reliable flow of the melted thermoplastic material in a fluid state with full control over the amount of the melted thermoplastic fed from the nozzle of the applicator gun. As illustrated in FIG. 3, an applicator nozzle 42 is inserted into the open end of a fuse casing 12 and a suitable quantity of the fluid thermoplastic adhesive 32 injected into the interior of the fuse casing.

The thermoplastic adhesive selected is capable of achieving a good bond or seal around a portion of the length of the wire-like fusible element. Further, the thermoplastic material is injected so that it positively engages the interior wall of the fuse casing so as to provide a good bond or seal to the inside of the casing. Many available thermoplastic hot-melt adhesives will result in such a seal because of the excellent substrate wetting characteristics of such materials. It has been found that hot melt thermoplastics will even provide a good bond or seal to the inside of a casing which has been made on a mandrel which was provided with a parting compound to facilitate removal of the mandrel from the casing following formation of the casing.

Another substantial advantage of a thermoplastic hot melt adhesive is its extremely fast set up and drying time; the material is virtually at full strength as soon as it cools. Further, critically important properties include the excellent insulating qualities and temperature resistant qualities of hot-melt thermoplastics. All of these advantages result in excellent performance of such materials in insulating and isolating the fuses end terminals from one another over a broad range of fuse operating conditions.

In a specific application wherein a fuse casing is made from a synthetic resin glass-cloth laminate (known in the industry as "GMG" tubing) having an internal diameter of 0.203 inches, it has been found that the length of the thermoplastic hot melt seal should be at least 30 percent of the diameter of the fuse casing. Such figure represents a lower limit and in actual practice the length of the fusible element surrounded by the body of thermoplastic adhesive is generally somewhat longer than this in order to assure repetitive reliable seals within the fuse casing. In this application, the thermoplastic adhesive used was a Dexter Hysol Polylefin-EVA, Catalog number 1X.

While the fuses shown in the drawings include a body of thermoplastic adhesive adjacent each end terminal it should be appreciated that a single body of thermoplastic adhesive injected at one end of a fuse is sufficient to establish the desired impermeable barrier. It should also be appreciated that such barriers regardless of how many, or where the barriers are located along the length of the fuse establish a good, reliable barrier without subjecting the fragile fusible element to potentially damaging forces caused by clamping or sandwiching the element between adjacent washers and barriers or the like.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. An electric fuse for interrupting relatively small currents in relatively high voltage circuits, which comprises:

a. a tubular casing having open ends;

b. a fusible element extending from one open end of said casing to the other open end thereof;

c. a pair of terminal caps, one of said caps permanently secured to and closing each of said open ends of said casing;

d. means for electrically conductively connecting the opposite ends of said fusible element to the respective terminal caps; and e. a body of solid thermoplastic hot melt adhesive inside said casing, said body being introduced into said casing in a melted state and surrounding only a portion of the length of said fusible element, said body being in intimate sealing contact with the inner surface of said casing which is in close proximity to said portion of the length of said fusible element, to thereby establish an impermeable barrier within said casing between the respective terminal caps, whereby, when the fusible element melts, under all fuse operating conditions, said impermeable barrier prevents the arc plasma from extending between and feeding on the end terminals, thus promoting quick estinguishment of the arc.

2. The electric fuse of claim 1 wherein said tubular casing has a predetermined inside diameter and wherein the length of said fusible element surrounded by said body of thermoplastic adhesive is at least 30 percent of said predetermined inside diameter.

3. The electric fuse of claim 1 wherein said body of thermoplastic adhesive is located adjacent one end of said casing.

4. The electric fuse of claim 3 wherein said tubular casing has a predetermined inside diameter and wherein the length of said fusible element surrounded by said body of thermoplastic adhesive is at least 30 percent of said predetermined inside diameter.

5. The electric fuse of claim 1 wherein a separate body of thermoplastic adhesive is located adjacent each of said ends of said fuse.

6. The electric fuse of claim 5 wherein said tubular casing has a predetermined inside diameter and wherein the length of said fusible element surrounded by each of said bodies of thermoplastic adhesive is at least 30 percent of said predetermined inside diameter.

* * * * *